US006140937A

United States Patent [19]

Wicks

[11] Patent Number: 6,140,937

[45] **Date of Patent: *Oct. 31, 2000**

[54] MODULAR PAGER UNIT REMOVABLY INCORPORATED WITH A PERSONAL ELECTRONIC DEVICE

[75] Inventor: James E. Wicks, San Francisco, Calif.

[73] Assignees: Sony Corporation, Tokyo, Japan; Sony Electronics Inc., Park Ridge, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/823,878

[22] Filed: Mar. 17, 1997

[51] Int. Cl.[7] ..... G08B 5/22

[52] U.S. Cl. ..... 340/825.44; 340/825.25; 340/825.15; 455/88; 455/426; 455/556

[58] Field of Search ..... 340/825.44, 825.15, 340/825.25; 455/550, 31.3, 556, 575, 557, 426, 31.2, 88, 567; 370/313

[56] References Cited

U.S. PATENT DOCUMENTS

| | | | |
|---|---|---|---|
| 4,856,088 | 8/1989 | Oliwa et al. | 340/825.44 X |
| 4,906,989 | 3/1990 | Kasugai | 340/825.44 |
| 5,257,307 | 10/1993 | Ise | 455/31.3 |
| 5,535,434 | 7/1996 | Siddoway et al. | 455/575 |
| 5,584,070 | 12/1996 | Harris et al. | 340/825.44 X |
| 5,654,942 | 8/1997 | Akahane | 340/825.44 X |
| 5,721,537 | 2/1998 | Protas | 340/825.44 |
| 5,767,786 | 6/1998 | Lopatukhin et al. | 340/825.44 |
| 5,774,798 | 6/1998 | Gaskill | 340/825.44 X |
| 5,822,692 | 10/1998 | Krishan et al. | 340/825.44 X |
| 5,854,984 | 12/1998 | Buhrmann et al. | 455/550 |

*Primary Examiner*—Brian Zimmerman
*Assistant Examiner*—Yves Dalencourt
*Attorney, Agent, or Firm*—Ronald P. Kananen; Rader, Fishman & Grauer

[57] ABSTRACT

A novel device combines the functions of a pager unit and a personal electronic device such as a radio tuner, a cassette tape player, or a compact disc player. Upon receipt of a transmission, the pager unit interrupts the audio signal of the personal electronic device with an alert signal which is heard through the headphones of the personal electronic device. The user can then view the received transmission. Alternatively, if the transmission is an audio or voice mail transmission, the transmission may be heard through the headphones following the alert signal.

19 Claims, 3 Drawing Sheets

MODULAR PAGER UNIT REMOVABLY INCORPORATED WITH A PERSONAL ELECTRONIC DEVICE

FIELD OF THE INVENTION

The present invention relates generally to the field of wireless pagers. More particularly, the present invention relates to a wireless pager unit which may be incorporated in a personal electronic device.

BACKGROUND OF THE INVENTION

Portable radio receivers and transceivers, such as wireless pagers, have become increasingly popular as a means of communication. Pagers are typically carried by users who wish or need to communicate when they are away from a telephone or computer, or are unable to predict where they may be reached at a given time.

In general, the user of a pager purchases the unit and enters into a contract with a service provider. As shown in FIG. 1, when someone 12 wishes to page a particular user, they contact the user's service provider 11, identify the user to be paged (perhaps with a personal identification number), and may give a message to the service provider 11 that is to be broadcast to the user's pager 15.

The service provider 11 maintains a network of radio transceiver base stations 13, 14 which are spread throughout the service area covered by the service provider. The transmitting base stations 13 are distributed so that transmissions from at least one base station can be received by a pager 15 anywhere in the service area.

In a simplistic system, when the service provider 11 receives a request to page a user 15, the page is broadcast by all the base stations 13 in the system. Thus, if the pager 15 is located anywhere in the service area, it will receive the page. The pager 15 will then alert the user that a page has been received with, for example, an audible or vibratory alert signal.

In a more sophisticated system, the pager 15 may have the capability to not only receive a transmission from the service provider's system, but may have the capability to transmit data back to the system. This is referred to as two-way paging.

Because the strength of a transmission from a pager 15 is tightly constrained by the battery power available to the pager, a two-way paging system must include a greater number of receiving base stations 14 than transmitting base stations 13. The receiving base stations 14 are smaller and distributed more widely than transmitting base stations 13 in order to receive the relatively weak transmissions broadcast by individual pagers 15. The receiving base stations 14 must be sufficient in number and distribution to receive pager transmissions originating anywhere in the service area.

While pagers allow users to communicate from almost any location, personal electronic devices, such as personal radios, cassette tape players, and compact disc players, may be battery-powered and thus can also be used while in transit or from almost any location. Accordingly, such personal electronic devices are frequently used during a variety of activities such as walking, jogging, driving, etc.

However, the simultaneous use of a personal electronic device and a pager may be difficult. For example, headphones are almost universally used to listen to a personal radio or stereo. Accordingly, a pager user who is listening to a personal radio or stereo through headphones may be unable to hear an auditory alert signal emitted by the pager to indicate that a message has been received. Moreover, if the pager user is also jogging or walking, it may be difficult to detect a vibratory signal emitted by the pager.

Accordingly, a need exists for an improved means and method of combining the functions of pager and personal electronic devices.

SUMMARY OF THE INVENTION

It is an object of the present invention to meet the above identified needs and others. Particularly, it is an object of the present invention to provide a pager unit which may be used separately or incorporated into the functions of a personal electronic device.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve the stated and other objects of the present invention, as embodied and described below, the invention encompasses a device having: a pager unit for receiving transmissions from a paging system; an audio unit for providing a first audio signal; an audio output jack for providing the first audio signal as an output of the device; and an electrical connection between the pager unit and the audio output jack whereby the pager unit may provide a second audio signal to the audio output jack. The audio unit may be a radio tuner, a cassette tape deck or a compact disk player.

The pager unit outputs the second audio signal when a transmission has been received, and the second audio signal comprises an alert signal. The second audio signal may further include audio transmission received from a paging system.

The electrical connection may include a switch. The switch may be controlled by the pager unit to close the connection when the second audio signal is generated. Otherwise, the switch connects the audio unit and the audio output jack.

The device may further include a pager unit port. In which case, the pager unit is removably inserted in the port to make the electrical connection. The device may also include a display disposed on the pager unit or on the device itself. The device may also include headphones plugged into the audio output jack. The pager unit may have a second audio output jack provided thereon.

The present invention also encompasses a pager unit having a memory unit disposed in the pager unit; and a microphone disposed on the pager unit. A message spoken into the microphone is stored in the memory unit.

The present pager unit may also have an audio output jack connected to the memory unit through which the stored message may be replayed, and an antenna with which the message may be transmitted to a paging system.

The present invention also encompasses a method of using a device. While providing a first audio signal, the method includes interrupting the first audio signal with a second audio signal to indicate reception of a transmission by a pager unit.

The present invention may also encompass another method of using a device by: providing a pager unit; providing a first audio signal to an audio output jack; electrically connecting the pager unit and the audio output jack; and providing a second audio signal from the paging unit to the audio output jack. Connecting the pager unit and output jack may include switching a switch to close a connection between the pager unit and the audio output jack.

The first audio signal may be provided with a radio tuner, a cassette tape deck or a compact disk player. The provision of the second audio signal is performed in response to receiving a transmission from a paging system with the pager unit, and the second audio signal comprises an alert signal. The second audio signal may also include an audio transmission received from a paging system. Otherwise, the present method may include displaying the transmission on a display.

The present method may continue by providing a pager unit port on the device; and removably inserting the pager unit in the port, and providing a second audio output jack on the pager unit.

The present invention also encompasses a method of using a pager unit by: speaking a message into a microphone which is provided on the pager unit; storing the message in a memory unit of the pager unit; replaying the message stored in the memory; and transmitting the message to a paging system.

BRIEF DESCRIPTION OF THE DRAWINGS

The accompanying drawings illustrate the present invention and are a part of the specification. Together with the following description, the drawings demonstrate and explain the principles of the present invention. In the drawings.

DETAILED DESCRIPTION OF THE PREFERRED EMBODIMENT

Figure 1:
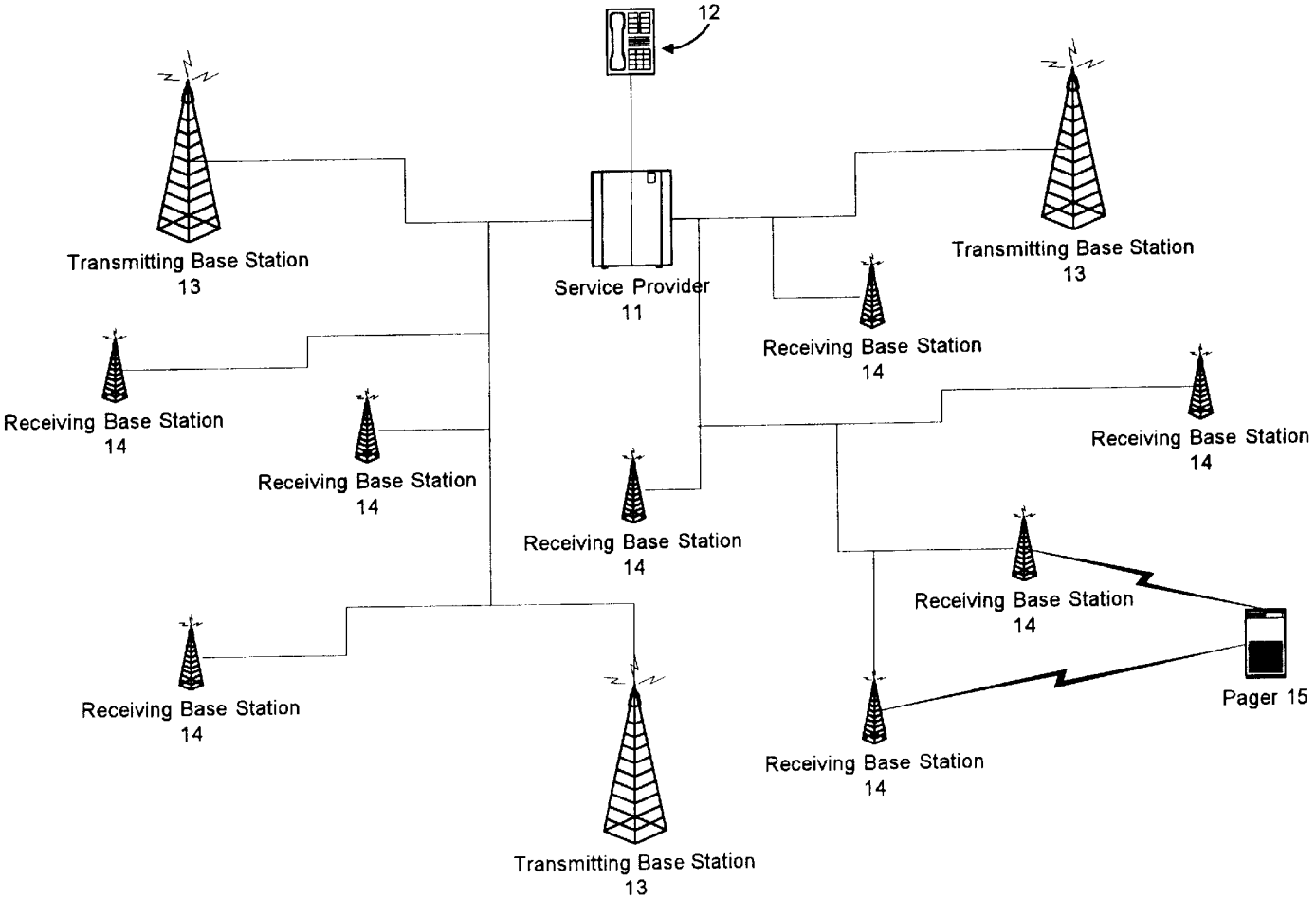
FIG. 1 is a schematic diagram of a two-way paging network with which a pager according to the present invention may be used.
Figure 2:
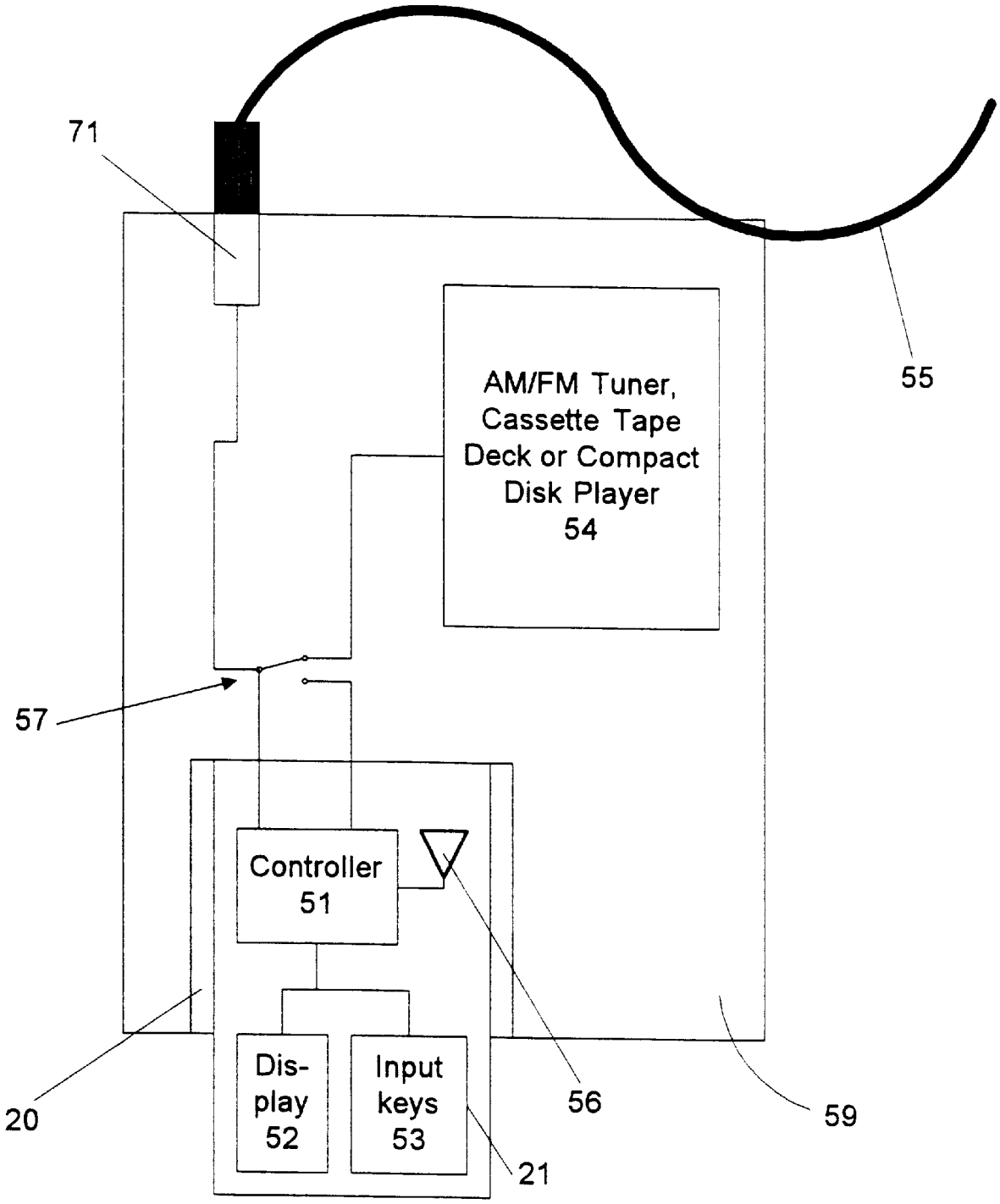
FIG. 2 illustrates a pager unit and personal electronic device according to the present invention.

Using the drawings, the preferred embodiment of the present invention will now be explained. As shown in FIG. 2, a pager unit 21 is incorporated into a personal electronic device 59, having, for example, an AM/FM tuner, cassette tape deck, or compact disk player 54. The personal electronic device 59 is also provided with a jack 71 through which headphones 55 may be connected for listening to the output of unit 54.

The personal electronic device 59 also has a pager unit port 20 in which a pager unit 21 may be inserted. Pager unit 21 may comprise all the necessary components of a stand-alone pager including a controller 51, a display 52, input keys 53 and an antenna 56. Accordingly, pager unit 21 may be used as a standard pager when not incorporated into personal electronic device 59. When the pager unit 21 is inserted into the pager unit port 20 of the personal electronic device 59, the pager 21 is electrically connected to the device 59.

The circuit between headphone jack 71 and the tuner, tape player or CD player 54 is made through a switch 57. If the pager unit 21 is not inserted in the port 20, switch 57 maintains a connection between the headphone jack 71 and the tuner, tape player or CD player 54.

However, when pager unit 21 is inserted in port 20 and electrically connected to the circuitry of device 59 as shown in FIG. 2, control of the switch 57 is given to the controller 51 of pager unit 21. When the switch 57 is controlled by the controller 51 of pager unit 21, the connection between the headphone jack 71 and the tuner, tape player or CD player 54 is maintained unless the pager unit 21 receives a message or transmission from the supporting paging system (not shown).

When the pager unit 21 receives a message or transmission, the signal is received by controller 51 through antenna 56. The controller 51 will then cause switch 57 to switch so that a connection is made between the controller 51 of the pager 21 and the headphone jack 71. The controller 71 then sends an audible alert signal via headphone jack 71 to the headphones 55. The signal will be emitted by the speakers in the headphones 55 and thus alert the listener that a page has been received.

The listener can then refer to the display 52 of the pager unit 21 to see the received message. Alternatively, a display could be provided on the personal electronic device 59 on which the message could be displayed by controller 51. In this way, the listener's use of personal electronic device 59 will not interfere with his or her receiving messages transmitted to pager 21.

The pager unit 21 may also be able to convey the entire message received to the user through headphones 55. For example, modern paging systems are moving toward a voice messaging system whereby the message transmitted to a pager is a brief audio message recorded and transmitted by a sender.

In such a case, the controller 51, may access the headphone jack 71 with switch 57 and may transmit to the listener an auditory alert signal that a message has been received. The alert signal is followed by a replay of the received message. The listener hears the alert and the message through headphones 55.

Figure 3:
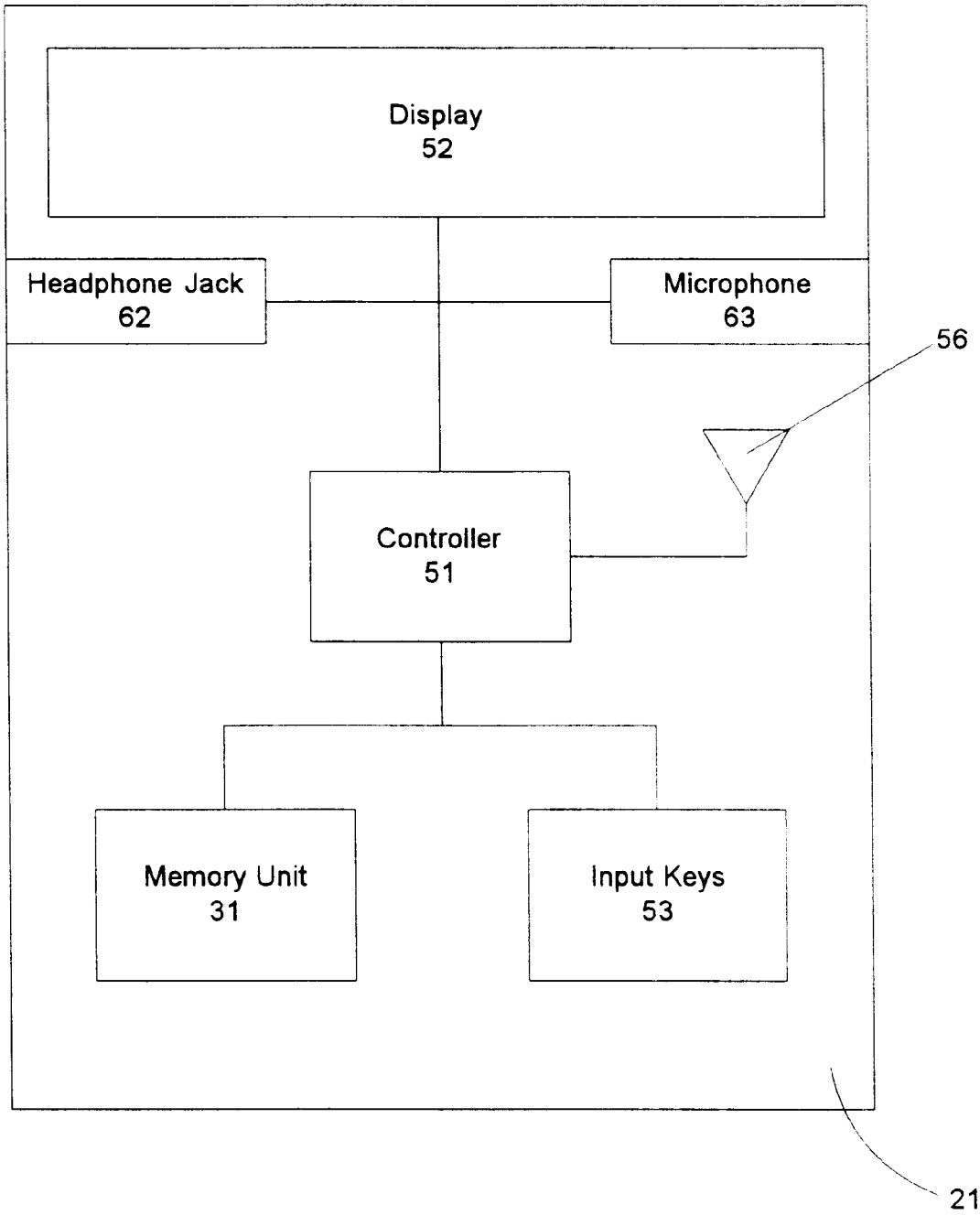
FIG. 3 illustrates a pager unit according to the present invention.

As shown in FIG. 3, a pager unit 21 of the present invention, may also be provided with its own headphone jack 62. In the event that a voice mail page is received and the pager is not connected to a personal electronic device, headphones or an earpiece may be plugged into headphone jack 62 to listen to the message. A speaker (not shown) may be provided on the pager 21 to provide an auditory alert that a message has been received and that headphones should be inserted into jack 62 to hear the message.

Pager 21 is also provided with a microphone 63 and a memory unit 31. In a two-way paging system, the pager user may speak a voice mail message into microphone 63. The message may then be transmitted to the paging system through antenna 56. Ultimately, the paging system will transmit the message to the pager of an intended recipient. The user of pager 21 may indicate the intended recipient by speaking an identification number for the recipient at the beginning or end of the message, or by indicating the identification number through input keys 53 in a variety of ways that will be known to those skilled in the art.

Additionally, pager 21 may serve as a voice memo recorder. If the pager user needs to make a brief note of an idea, commitment, etc., he or she may speak the message into microphone 63 while indicating that the memo is to be recorded using input keys 53. The memo is then stored in the memory unit 31.

To replay the memo, the pager user must either insert headphones in jack 62 or incorporate the pager unit 21 into a personal electronic device to which headphones are or may be attached. Using input keys 53, the pager user then signals the controller 51 to retrieve and replay the recorded memo. The controller 51 accesses memory unit 31 and replays the memo through headphones in jack 62 or jack 71 as appropriate The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A device comprising:

a pager unit for receiving transmissions from a paging system;

an audio unit, separate from said pager unit, for receiving an audio recording medium from which said audio unit generates a first audio signal, said audio unit further comprising a separate pager unit port for receiving said pager unit;

an audio output jack for providing said first audio signal as an output of said device; and an electrical connection between said pager unit and said audio output jack whereby said pager unit may provide a second audio signal to said audio output jack.

2. A device as claimed in claim 1, wherein said audio unit is a cassette tape deck or a compact disk player and said recording medium is a cassette tape or compact disk.

3. A device as claimed in claim 1, wherein said pager unit outputs said second audio signal when a transmission has been received and said second audio signal comprises an alert signal.

4. A device as claimed in claim 3, wherein said second audio signal further comprises an audio transmission received from a paging system.

5. A device as claimed in claim 3, wherein said connection comprises a switch, said switch being controlled by said pager unit to close said connection when said second audio signal is generated, wherein said switch otherwise connects said audio unit and said audio output jack.

6. A device as claimed in claim 1, wherein said pager unit is removably inserted in said pager unit port to make said electrical connection.

7. A device as claimed in claim 6, comprising a display disposed on said pager unit.

8. A device as claimed in claim 1, comprising a display disposed on said audio unit which is controlled by said pager unit through said electrical connection and on which said pager unit displays received transmissions.

9. A device as claimed in claim 1, further comprising headphones plugged into said audio output jack.

10. A device as claimed in claim 6, further comprising a second audio output jack for receiving headphones, said second audio output jack being provided on said pager unit.

11. A method of using a pager unit comprising:

playing a recording medium with an audio device separate from said pager unit to provide a first audio signal to an audio output jack of said audio device, wherein said audio device further comprises a separate pager unit port in which said pager unit is removeably inserted and through which said pager unit is electrically connected to said audio output jack; and providing a second audio signal from said paging unit to said audio output jack.

12. A method as claimed in claim 11, wherein said providing a first audio signal is performed with a cassette tape deck or a compact disk player.

13. A method as claimed in claim 11, wherein said providing a second audio signal is performed in response to receiving a transmission from a paging system with said pager unit, and said second audio signal comprises an alert signal.

14. A method as claimed in claim 13, wherein said second audio signal further comprises an audio transmission received from a paging system.

15. A method as claimed in claim 13, wherein said electrically connecting said pager unit and said audio output jack comprises switching a switch to close a connection between said pager unit and said audio output jack.

16. A method as claimed in claim 13, further comprising displaying said transmission on a display.

17. A method as claimed in claim 11, further comprising providing a second audio output jack for receiving headphones, said second audio output jack being provided on said pager unit.

18. A device comprising:

a pager unit for receiving transmissions from a paging system;

an audio unit, separate from said pager unit, for providing a first audio signal from a radio tuner incorporated into said audio unit, said audio unit having a separate pager unit port for receiving said pager unit;

an audio output jack for providing said first audio signal as an output of said device; and an electrical connection between said pager unit and said audio output jack whereby said pager unit may provide a second audio signal to said audio output jack.

19. The device of claim 18, wherein said audio unit further comprises a cassette or disk player having a recording medium port separate from said pager unit port.

* * * * *